US005238128A

United States Patent [19]

Stoddard

[11] Patent Number: 5,238,128

[45] Date of Patent: Aug. 24, 1993

[54] KNOCKDOWN DISPLAY STAND

[75] Inventor: David C. F. Stoddard, Atlanta, Ga.

[73] Assignee: The Mead Corporation, Dayton, Ohio

[21] Appl. No.: 720,117

[22] Filed: Jun. 24, 1991

[51] Int. Cl.[5] ..... A47F 5/16

[52] U.S. Cl. ..... 211/188; 211/133; 108/111

[58] Field of Search ..... 211/188, 186, 126, 133; 108/111, 150; 248/165, 439

[56] References Cited

U.S. PATENT DOCUMENTS

| | | | |
|---|---|---|---|
| 1,762,596 | 6/1930 | Soper | 211/128 |
| 2,747,748 | 5/1956 | Barefoot | 211/126 |
| 3,121,496 | 2/1964 | Brunette | 211/126 |
| 3,163,296 | 12/1964 | Hohnstein | 211/126 |
| 3,523,694 | 8/1970 | Oliver | 211/126 X |
| 3,927,769 | 12/1975 | Maslow et al. | 211/153 |
| 4,467,927 | 8/1984 | Nathan | 211/186 X |
| 4,574,709 | 3/1986 | Lackey et al. | 108/111 |
| 4,621,740 | 11/1986 | Lang | 211/133 |
| 4,759,451 | 7/1988 | Apps | 211/126 |
| 4,905,847 | 3/1990 | Hanson | 211/184 |
| 4,930,643 | 6/1990 | Flum | 211/188 |
| 4,940,150 | 7/1990 | Spengler | 211/188 |
| 4,941,784 | 7/1990 | Flament | 211/184 X |

*Primary Examiner*—Alvin C. Chin-Shue
*Attorney, Agent, or Firm*—Tsugihiko Suzuki

[57] ABSTRACT

A knockdown stand for displaying merchandise, includes shelf members vertically spaced apart in tiered relationship by vertically extending post members positioned between the shelf members. Each post member is separably connected at its upper and lower end portions respectively to the upper and lower adjacent shelf members to connect the upper and lower adjacent shelf members in knockdown relationship. Each shelf member includes a post holder provided thereon for releasably holding one or more post members when the one or more post members are disconnected at their upper and lower end portions from the associated shelf members.

20 Claims, 8 Drawing Sheets

KNOCKDOWN DISPLAY STAND

BACKGROUND OF THE INVENTION

The present invention relates to a knockdown display stand for use in merchandising products, and more particularly to a portable display stand designed for compact storage and easy relocation from one store to another.

In the merchandising of a number of products such as packaged, canned or bottled food or drink products, the products are typically displayed on the tiered shelves of a display stand at a supermarket or other retail store. Display stands or racks of such a type, frequently, do not belong to retail stores, but belong to the wholesalers or the manufacturers of the displayed merchandise. As a result, relocation of a display stand from one store to another is often required to efficiently utilize the same display stand in number of stores. Also, since the number of items displayed at a store fluctuates from week to week, storage of additional or unnecessary shelves at the store may be required. For convenience of relocation and storage, knockdown or collapsible structure of a display stand has been an important factor.

Among the prior art, U.S. Pat. Nos. 3,121,496 and 3,523,694 disclose display stands which can be knocked down or collapsed easily into compact units, respectively. These display stands include basket-type shelves, each being of a preassembled structure having built-in posts or spacer members adapted to be vertically extended between two shelves. Due to their outdated appearance and inefficiency in the manufacturing, display stands of these types are not in widespread use.

U.S. Pat. Nos. 4,467,927 and 4,930,643 describe knockdown display stands formed, typically, of molded plastics. These display stands include tray-shaped shelves and separate posts designed to be positioned between the shelves. Each shelf is provided with integrally formed sockets for releasably receiving the ends of the posts, and the display stand may be conveniently taken apart. One disadvantage of such display stands is that upon disassembly, it is not easy to keep the parts for a display stand together in organized condition. This can result in loss of some of the parts, the posts in particular, of a display stand during "knock down" relocation, or "knock down" storage. Further, a box or other container must be found for holding the parts.

What is needed, therefore, is a display stand for merchandising products. Such a display stand should be efficiently manufacturable, capable of being knocked down into a compact unit, and easy to keep in organized condition upon disassembly.

SUMMARY OF THE INVENTION

The present invention provides a knockdown display stand for merchandising products. The display stand according to the present invention includes a plurality of shelves vertically spaced apart in tiered relationship by a plurality of vertically extending posts positioned between the shelves. Each post is separably connected at its upper and lower end portions respectively to the upper and lower adjacent shelves to connect the upper and lower adjacent shelves in knockdown relationship. Each shelf is provided with a post holder for releasably holding at least one of the posts when such a post is disconnected at its upper and lower end portions from the associated shelves.

Upon disassembly of the display stand, the disconnected posts can be held by and thus attached to the shelves so that loss of the attached posts can be effectively prevented. Extra posts may be attached to some of the shelves by means of the post holder in order to be utilized in case of loss of some of the posts.

It is preferred that the post holder of each shelf is capable of holding at least all of the posts interconnecting the corresponding shelf with the upper or lower adjacent shelf.

In one embodiment of the present invention, the post holder is a groove or grooves formed in the upper surface of a base portion of each shelf. The base portion is generally horizontal and planar and is adapted to support merchandise. Each groove may be provided with a post engagement means so that a post received in the groove is prevented from accidentally coming out of the groove.

According to a preferred embodiment, each shelf includes a peripheral flange attached to the base portion and extending generally vertically from the base portion to a free end. The perimeter of the flange is greater at the free end than at the attachment to the base portion. This arrangement permits, upon disassembly, the shelves to be stacked one on top of another in nesting relation. A strap for fastening the stacked shelves together is removably attached to one of the shelves by means of a strap holder provided on each shelf. A wheel means for facilitating movement of the display stand is connected to the lowermost shelf. This arrangement allows the display stand to be knocked down into a compact stacked unit convenient for relocation from one store to another.

The present invention also provides a knockdown display stand in which the shelves are designed to be stackable in such a manner that each shelf nests in the upper adjacent shelf. Each shelf includes a peripheral flange attached to the periphery of the base portion and projecting below the base portion to a lower free end to define a hollow with an open bottom. The perimeter of the peripheral flange is greater at the lower free end than at the attachment to the base portion. Further, each shelf includes a merchandise prop means for supporting merchandise, such as packaged food products, in erected condition. The prop means extends upward from the base portion of each shelf so that at least a part of the prop means can be received, when the shelves are stacked, in the hollow of the upper adjacent shelf. This arrangement permits the shelves to be stacked without the prop means of each shelf interfering with the upper adjacent shelf.

The present invention further provides a knockdown display stand in which the shelves are designed to be stackable in nesting fashion. In this display stand, each shelf has a U-shaped guard member for confining and retaining merchandise on the base portion. The guard member is pivotally mounted at its legs on a periphery of the base portion for movement between a collapsed position where the guard member is generally parallel to the base portion and an erected position where the guard member is generally perpendicular to the base portion. When the shelves are stacked, the guard member of each shelf can avoid interference with the upper adjacent shelf since it is collapsible. Because of its shape, the guard member does not obstruct the inspection of the merchandise on the shelf by customers.

Accordingly, it is an object of the present invention to provide a knockdown display stand which is easy to keep in organized condition upon disassembly.

Another object of the present invention is to provide a display stand which can be knocked down into a compact unit.

A further object of the present invention is to provide a display stand which is convenient for "knock down" storage and "knock down" relocation from one store to another.

A further object of the present invention is to provide a knockdown display stand which is easy to assemble and disassemble.

A further object of the present invention is to provide a knockdown display stand which can be efficiently manufactured.

Other objects and advantages of the present invention will be apparent from the following description, the accompanying drawings and the appended claims.

DETAILED DESCRIPTION OF THE PREFERRED EMBODIMENT

Figure 1:
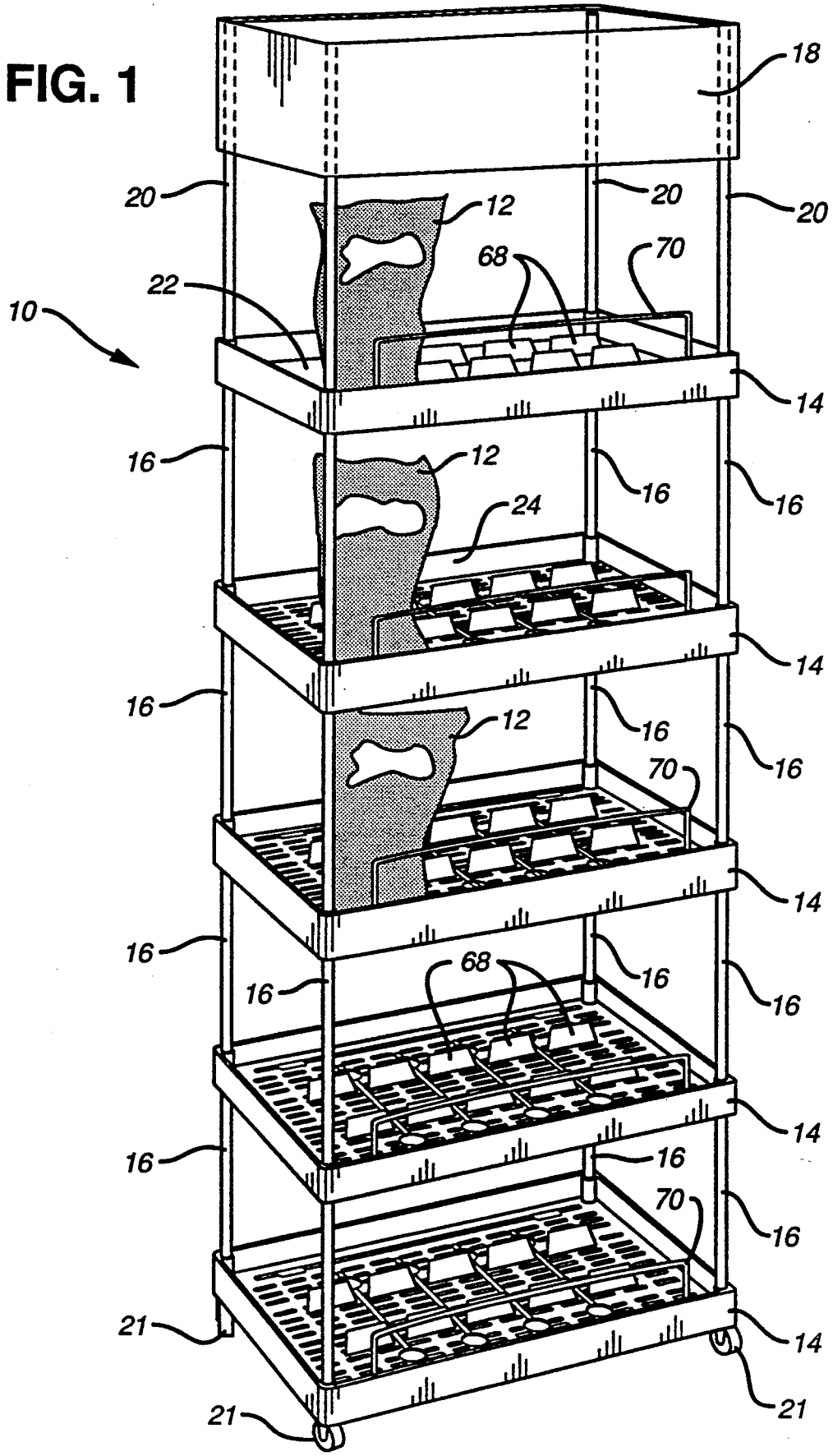
FIG. 1 is a perspective view of a knockdown display stand according; to the present invention.

FIGS. 1 to 9 illustrates an embodiment of the present invention, where FIG. 1 shows a knockdown stand, generally designated 10, for displaying food or drink products 12, particularly packaged food products such as potato chips, tortilla chips or the like. The display stand 10 includes a plurality of vertically spaced shelves 14 of the same size and shape and a plurality of vertically extending posts 16 positioned and connecting between the spaced apart shelves 14 to vertically tier the same one above another. Each of the posts 16 is separably connected at its upper and lower end portions to the upper and lower adjacent shelves 14 to enable disassembly of the display stand 10. Four posts 16 are employed to interconnect every two adjacent shelves 14. A header 18 is supported over the topmost shelf 14 by four vertically extending header posts 20 to attractively advertise and focus attention upon the specific products on the display stand 10. Each header post 20 is also connected at its upper and lower end portions respectively to the header 18 and the adjacent shelf 14. Wheel means such as casters or rollers 21 are detachably connected to the lowermost shelf 14. The casters 21 are fabricated so as to be engageable with the sockets (which will be described later) on each shelf 14, and facilitate movement and/or relocation of the display unit 10.

While the display stand 10 in FIG. 1 is shown with five shelves 14, more or less shelves may be employed to provide a display stand of any usable or desired height. More or less than four posts 16 may be used to interconnect two adjacent shelves 14. A wide variety of different headers may be employed, and more or less than four header posts 20 may be used. However, the header 18 and the header posts 20 may be omitted.

Each post 16, as well as each header post 20, is preferably tubular in shape and has a substantially circular cross section; the posts 16 and 20 may, however, be solid and of a cross section of any other suitable shape. The posts 16 are preferably all of the same length and shorter than the header posts 20. All the posts 16 and 20 are preferably of the same outside diameter. The posts 16 and 20, however, may be designed into a variety of lengths and diameter so long as a set of the posts which interconnect two adjacent shelves 14 has the same length and so long as the outside diameter does not exceed the vertical length of a peripheral flange which is described later in greater detail.

Figure 2:
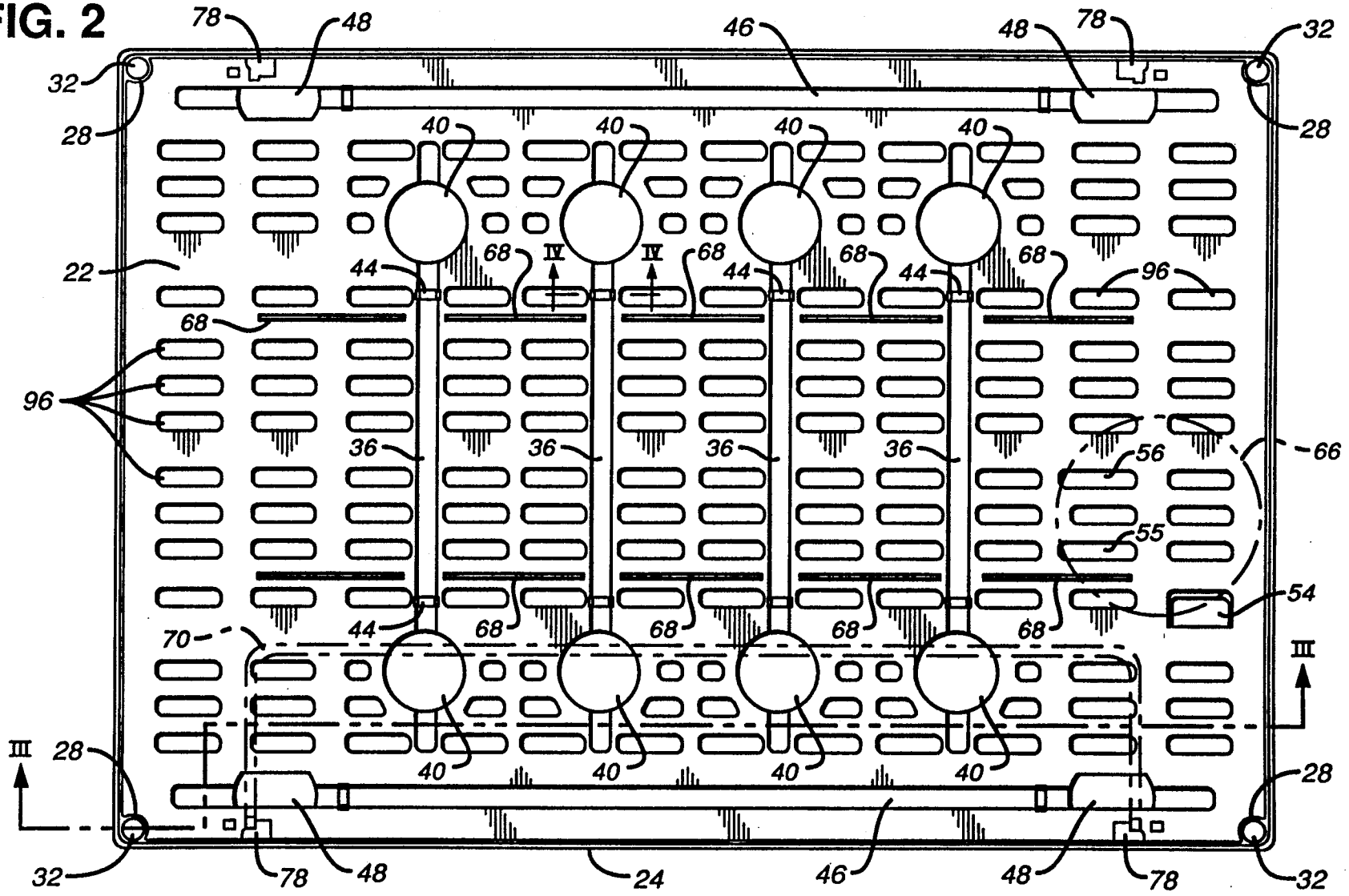
FIG. 2 is a plan view of a shelf of the display stand in FIG. 1.

Each of the shelves 14, as best seen in FIG. 2, includes a generally horizontal planar base panel 22 and a peripheral flange 24 integrally formed with the base panel 22. The base panel 22 is adapted to support the products 12 thereon and is essentially rectangular in shape. The base panel 22, however, may be fashioned into a variety of different sizes and shapes, for example, square, circular, hexagonal, or some other configuration. The peripheral flange 24 is formed continuously along the periphery of the base panel 22.

Figure 3:
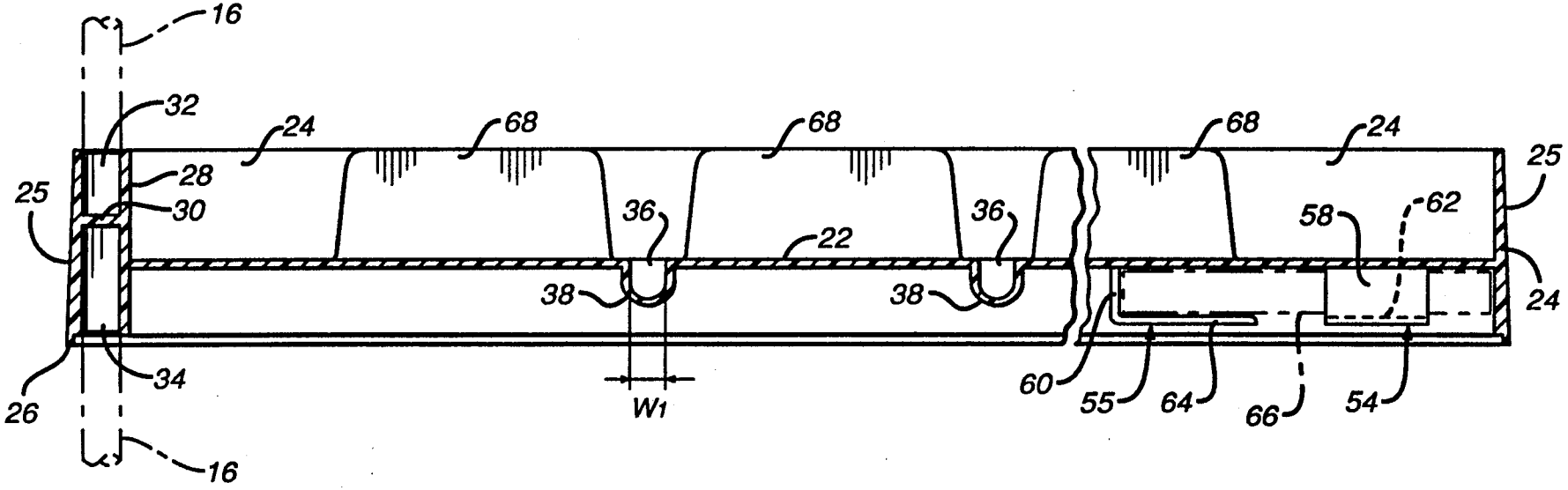
FIG. 3 is a fragmentary view taken along the line III—III in FIG. 2.

As best seen in FIG. 3, the peripheral flange 24 lies in a generally vertical plane transverse to the base panel 22 and projects both above and below the base panel 22. The portion of the flange 24 that projects above the base panel 22 serves, in part, as a rail to confine the products 12 on the base panel 22. The entire flange 24 serves as a peripheral reinforcement of the shelf 14, providing reinforcement, or resistance, against bending or twisting of the base panel 22 and of the entire shelf 14.

Figure 8:
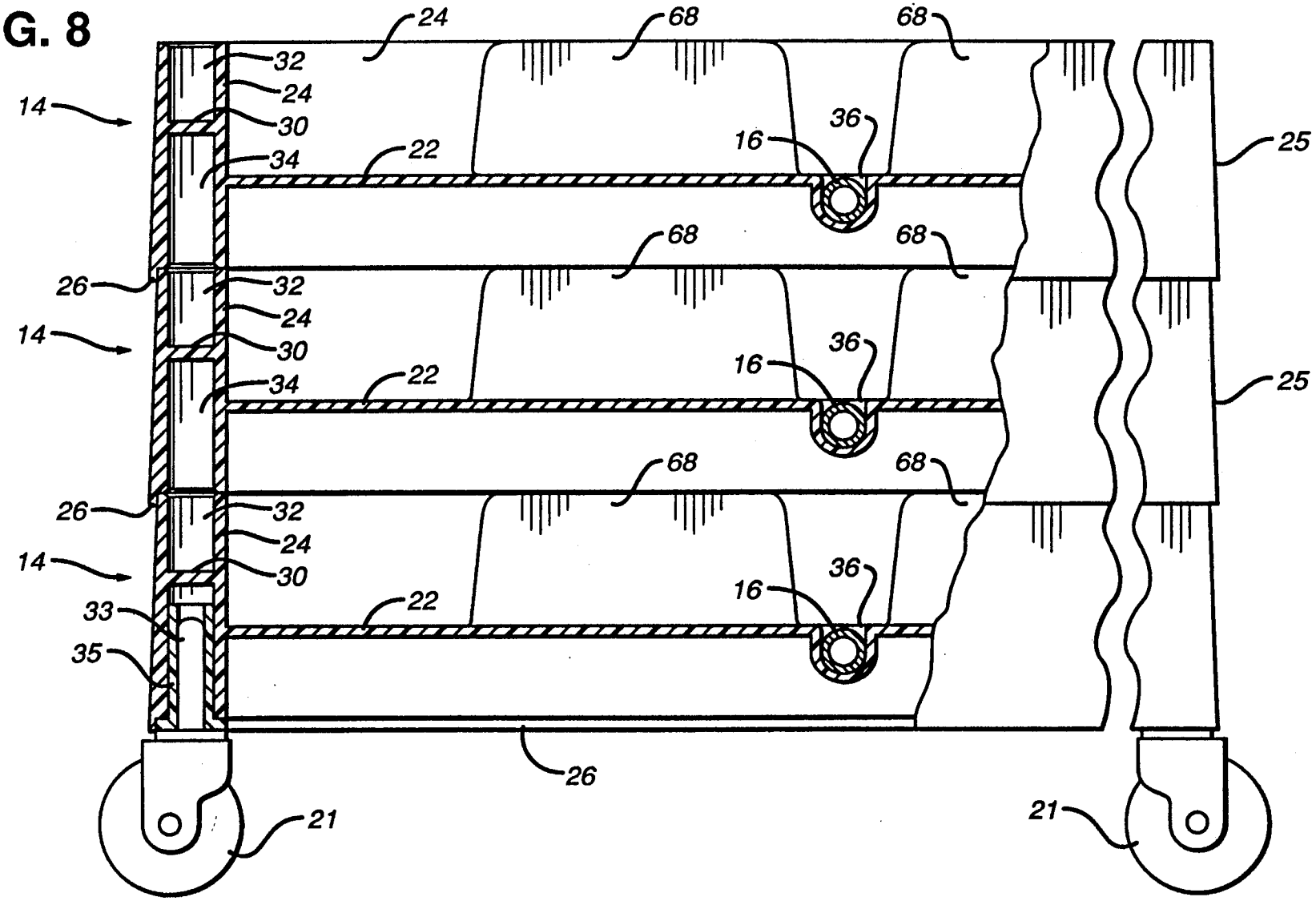
FIG. 8 is a side elevational view, partly in section, of the shelves stacked one on top of another.

As best illustrated in FIGS. 3 and 8, the outer vertical surface 25 of the flange 24 is slightly flared downwardly and outwardly so that the perimeter of the flange 24 is greater at the lower end of the flange 24 than at the upper end of the same. An integral engaging ridge 26 is formed on the lower end face of the flange 24 entirely along the periphery of the flange 24. The inner perimeter of this engaging ridge 26 is greater than the inner perimeter of the lower end of the flange 24 and is substantially equal to or slightly greater than the outer perimeter of the upper end of the flange 24. This arrangement permits, upon disassembly of the display stand 10, the shelves 14 to be stacked one on top of another with each shelf 14 precisely nesting in the upper adjacent shelf 14, as shown in FIG. 8. Reference numeral 27 denotes a shoulder on which, when the shelves 14 are stacked, the upper end of the lower adjacent shelf 14 abuts.

Persons skilled in the art will appreciate that alternately with the above-mentioned arrangement, the outer peripheral surface 25 of the flange 24 may be flared upwardly and outwardly, and the engaging ridge 26 may be formed on the upper end face of the flange 24 so that each shelf 14 can nest in the lower adjacent shelf 14.

Each shelf 14 also includes connection means in the form of tubular sockets 28 with which the end portions of the posts 16 and 20 are separably engaged. These sockets 28, as seen in FIG. 2, are located respectively at the corners of the rectangular base panel 22 and are formed integrally with the base panel 22 and with the peripheral flange 24. As illustrated in FIG. 3, each of the tubular sockets 28 is axially extended both above and below the base panel 22 to a vertical extent generally equal to the peripheral flange 24. The location of the sockets 28 relative to the peripheral flange 24 is such that the flange 24 of a rectangular frame structure has each of its rounded corners in common with the corresponding one of the sockets 28 (see FIG. 2). More particularly, the inner vertical surface of each rounded corner of the peripheral flange 24 merges with a portion of the corresponding tubular socket 28.

As best illustrated in FIG. 3, the internal space of each socket 28 is partitioned by a transverse wall 30 into two cavities, i.e., an upper cavity 32 which receives the lower end portion of the upper adjacent post 16 or 20 and a lower cavity 34 which receives the upper end portion of the lower adjacent post 16. The cavities 32 and 34 are preferably of generally cylindrical configuration to correspond to the shape of the opposite end portions of the posts 16 and 20; however, the cavities may be of any other shape and size, such as triangular, hexagonal, or some other configuration, which allows the cavities to telescopingly receive and separably engage the end portions of the posts 16 and 20. The diameter of the upper and lower cavities 32 and 34 (i.e., the inside diameter of each socket 28) is preferably substantially equal to the outside diameter of the posts 16 and 20 so as to provide frictional engagement between the sockets 28 and the posts 16 and 20. The partition wall 30 is located between the upper and lower ends of each tubular socket 28, at a position closer to the upper end of the corresponding socket 28 than to the lower end of the same.

In addition, the lower cavity 34 of each socket 28 is capable of receiving the connection rod 33 of a caster 21 through a tubular caster insert or cap 35 as shown in FIG. 8. The casters 21 are separably connected to the lowermost shelf 14 by means of the associated lower cavities 34.

Returning to FIG. 2, provided on the base panel 22 of each shelf 14 are post holders in the form of a plurality of grooves 36. Each groove 36 is adapted to releasably hold one of the posts 16 or an extra post of a similar structure when such a post is disconnected at its upper and lower end portions from the associated shelves 14. It is preferred that the number of the grooves 36 on each shelf 14 is equal to or greater than the number of the posts 16 which are used to interconnect two adjacent shelves 14 so that each shelf 14 is capable of holding at least all the upper adjacent posts 16.

In a preferred embodiment of the present invention, four grooves 36 are formed in the upper surface of the base panel 22 in spaced parallel relationship. The grooves 36 are disposed substantially parallel to the shorter edges of the base panel 22. Each groove 36 is extended from a point spaced from one of the longer edges of the base panel 22 to a point spaced from the other longer edge of the base panel 22. The length of each groove 36 is equal to or greater than that of each post 16, and the width ($W_1$) of each groove 36 (see FIG. 3) is equal to or larger than the outside diameter of each post 16. The depth of each groove 36 is preferably equal to or greater than the outside diameter of each posts 16 and less than the vertical length of that portion of the peripheral flange 24 projecting below the base panel 22. As shown in FIG. 3, these grooves 36 are defined by the respective internal surfaces of channel-shaped walls 38 depending from the lower surface of the base panel 22.

As further illustrated in FIG. 2, the base panel 22 of each shelf 14 is also provided with a plurality of finger-receiving apertures 40 formed therein. The location of these apertures 40 are such that each channel-shaped wall 38 is interrupted by at least one of the apertures 40. The size and shape of each aperture 40 are such that a person can insert his or her finger into the aperture 40 when a post 16 is received in the associated groove 36.

In FIG. 2, two apertures 40 intersect each groove 36 at locations adjacent respectively to the opposite ends of the corresponding groove 36. Each aperture 40 is circular in shape and of an inside diameter considerably greater than the outside diameter of each post 16 so that when a post 16 is positioned within the associated groove 36, spaces large enough to receive fingers are still provided at the opposite sides of the post 16.

Each groove 36 is provided with engaging means for resiliently engaging a post 16 when the post 16 is positioned in the corresponding groove 36. This engaging means prevents the post 16 from accidentally coming out of the groove 36.

Figure 4:
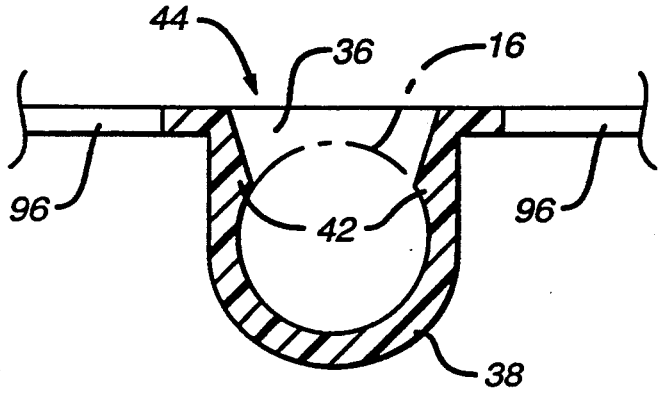
FIG. 4 is a view taken along the line IV—IV in FIG. 2.

In a preferred embodiment, resiliently engaging means in the form of two pairs of protrusions 42 are formed on the internal surface of each groove 36 as illustrated in FIG. 4. These two pairs are located at a distance along the length of the associated groove 36 (see FIG. 2, reference numeral 44). Each pair of the protrusions 42 are located adjacent to the opening of the associated groove 36. Each pair of the protrusions 42 are opposed to each other in such a manner that they define in the associated groove 36 a neck portion 44 which is less in width than the remainder of the groove 36. The width of such a neck portion 44, i.e., the distance between the opposed protrusions 42, is slightly less than the outside diameter of each post 16. Although a plurality of discrete protrusions 42 such as shown in FIG. 4 are preferred as the engaging means, a rib or ribs formed along the length of each groove 36 may be employed in place of the protrusions 42.

Returning again to FIG. 2, formed in the base panel 22 respectively along the longer edges of the same are additional post holders, i.e., two longer grooves 46. Each longer groove 46 is adapted to releasably receive one of the header posts 20 or an extra header post of a similar structure when such a post is disconnected from the associated shelf 14 and the header 18. Each longer groove 46 is extended from a point spaced from one of the shorter edge of the base panel 22 to a point spaced from the other shorter edge of the base panel. Each longer groove 46 is greater in length than each groove 36 so as to be suitable to receive the header post 20. Each groove 46 intersects two finger-receiving apertures 48 formed in the base panel 22 adjacent respectively to the opposite ends of the corresponding groove 46. Each aperture 48 conforms in shape to a part of one of the apertures 40. Other structure and arrangement related to the grooves 46 such as channel-shaped wall 50 and engaging means 52 (see FIG. 6) are now obvious since they are similar to those related to the grooves 36.

While it is preferred to form the grooves 36 and 46 in the base panel 22, persons skilled in the art will appreciate that these grooves may be formed in the outer or inner vertical surface of the peripheral flange 24.

As shown in FIGS. 2 and 3, the base panel 22 of each shelf 14 is further provided at its lower surface with an integral strap holder comprised of three L-shaped clips 54, 55 and 56. Each of the clips 54, 55 and 56 includes a vertically extending portion attached at its upper end to the lower surface of the base panel 22 and another portion horizontally extending from the lower end of the vertical portion. More particularly, the clip 54 is located near one of the edges of the base panel 22, while the clips 55 and 56 are located at a greater distance from the same edge of the base panel 22, with the horizontal portions 64 of the clips 55 and 56 extending generally toward but at right angle to the horizontal portion 62 of the clip 54, as seen in FIG. 2.

The above arrangement permits a space for receiving a fastening means 66 to be defined by the clips 54, 55 and 56 and the portion of the flange 24 opposing the clips 55 and 56. More specifically, this space is such that the fastening means in the form of a rolled strap 66 can be inserted into and taken out of the space through the opening defined between the vertical portion 60 of the clip 56 and the opposing portion of the flange 24 (see FIG. 2). The vertical portion 58 of the clip 54 defines the lower end, as viewed in FIG. 2, of the space, whereas the horizontal portions 62 and 64 of the clips 54, 55 and 56 define the bottom, as viewed in FIG. 3, of the space. The length of the vertical portions 58 and 60 is preferably equal to or slightly less than the width of the strap 66 to resiliently grip a roll of the strap 66 between the lower surface of the base panel 22 and the horizontal portions 62 and 64 of the clips 54, 55 and 56.

The strap wound into a roll 66 is detachably attached to one of the shelves 14, preferably the lowermost shelf, by means of the associated clips 54, 55 and 56 as shown in FIGS. 2 and 3. The strap 66 is essentially flat in shape and is of a length such that when the shelves 14 are stacked one on top of another, the strap 66 is capable of being wound at least once around the stacked shelves 14.

Figure 5:
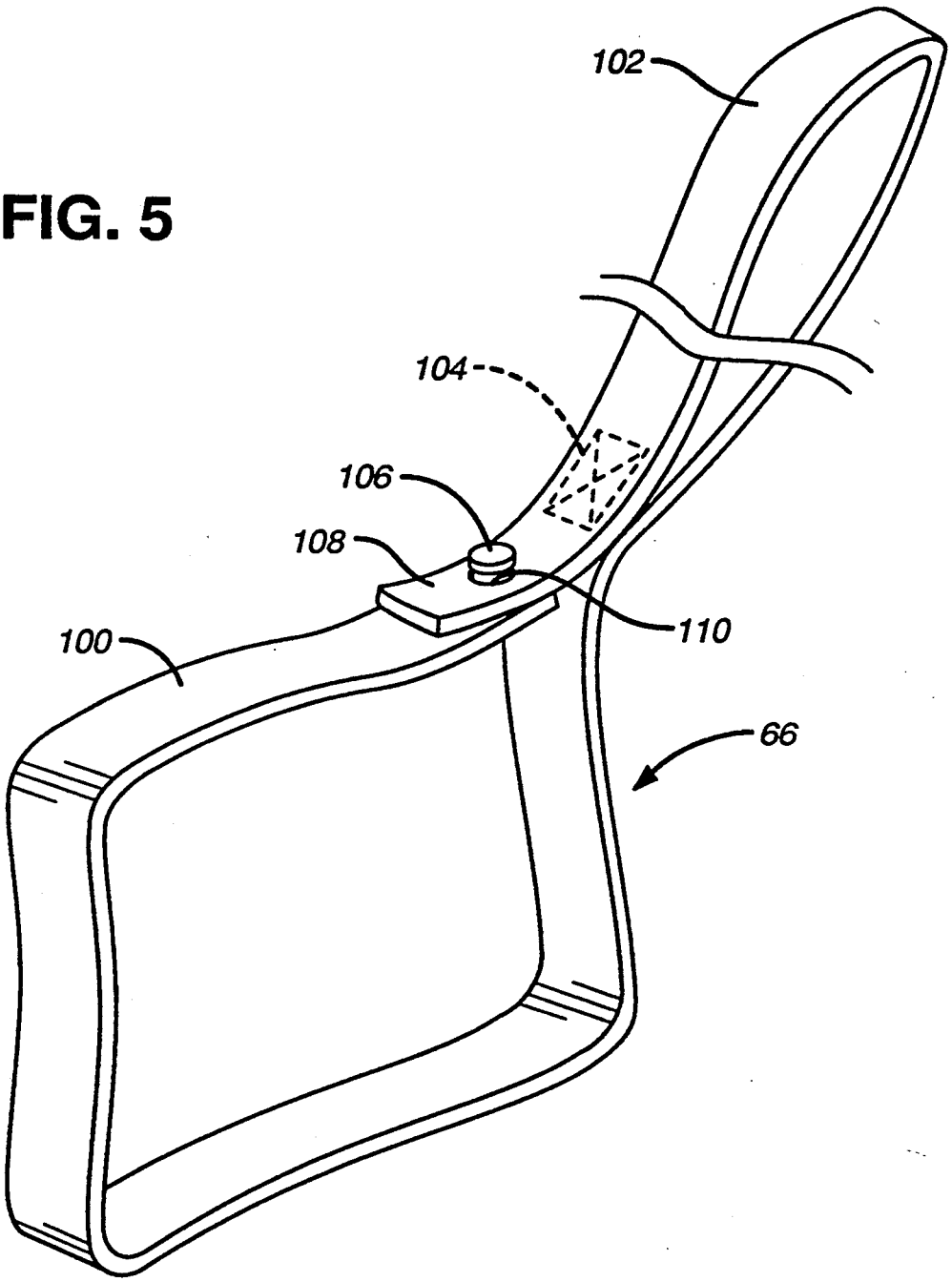
FIG. 5 is a perspective view of a strap shown in FIG. 2.

In a preferred embodiment, the strap 66 includes a main portion 100 which is adapted to be wound around stacked shelves 14 and a loop portion 102 adapted to be used as a handle, as shown in FIG. 5. The loop portion 102 is continuous with and joined to one of the ends of the main portion 100 and is formed into a loop by seams 104. The other end of the main portion 100 is provided with an end connector 106 such as a button, e.g., a metal button which is typically used on jeans. The free end 108 of the loop portion 102 has a buttonhole 110 for engaging with the button 106. The length of the main portion 100 is generally equal to the perimeter of the cross section of five shelves 14 stacked one top of each other.

The strap 66 may have an extra length in the main portion 100 and a plurality of buttonholes and/or buttons so as to be applicable to various numbers of shelves to be stacked. Snap fasteners, buckles and other known end connectors may be used instead of the button and buttonhole 106 and 110.

The base panel 22 of each shelf 14 is further provided with a plurality of integral prop members 68 adapted to be positioned behind the products 12, such as packaged potato chips, to support the same in erected condition as shown in FIG. 1.

It is preferred that the prop members 68 are arranged, in rows and columns, on the upper surface of the base panel 22 at locations where the grooves 36 and 46 and the apertures 40 and 48 are not present, as shown in FIG. 2. Each prop member 68, as best shown in FIG. 3, projects from the upper surface of the base panel 22 to a vertical extent equal to the peripheral flange 24 and is extended in a direction parallel to the longer edges of the base panel 22. Prop members of a greater vertical length are preferred to provide an effective support for the product 12, and the vertical length of the prop members 68 may even exceed the vertical length the portion of the flange 24 projecting above the base panel 22. However, it is important to limit the prop members 68 to a vertical length such that, when the shelves 14 are stacked, the members 68 of each shelf 14 do not interfere with the base panel 22 of the upper adjacent shelf 14 or with an reinforcing ribs (which are described later in more detail) on the lower surface of the upper adjacent shelf 14. As an alternative, the prop members 68 may be hollow and open at the bottoms so that the members 68 on adjacent stacked shelves 14 can be nested.

Although the prop members 68 in two rows and five columns are illustrated in FIG. 2, they may be arranged in rows and columns of variety of different number.

As further illustrated in FIGS. 1 and 2, each shelf 14 is provided with guard means 70 adapted to assist the peripheral flange 24 in confining and retaining the products 12 supported on the base panel 22. The guard means 70 may be provided along all the longer and shorter edges of the base portion 22; in the drawings, however, only one of the longer edges is provided with the guard means in the form of a U-shaped wire 70. This U-shaped wire 70 is pivotally connected to the base panel 22 for movement between an erected position shown in FIG. 1 and a collapsed position shown in FIG. 2.

Figure 6:
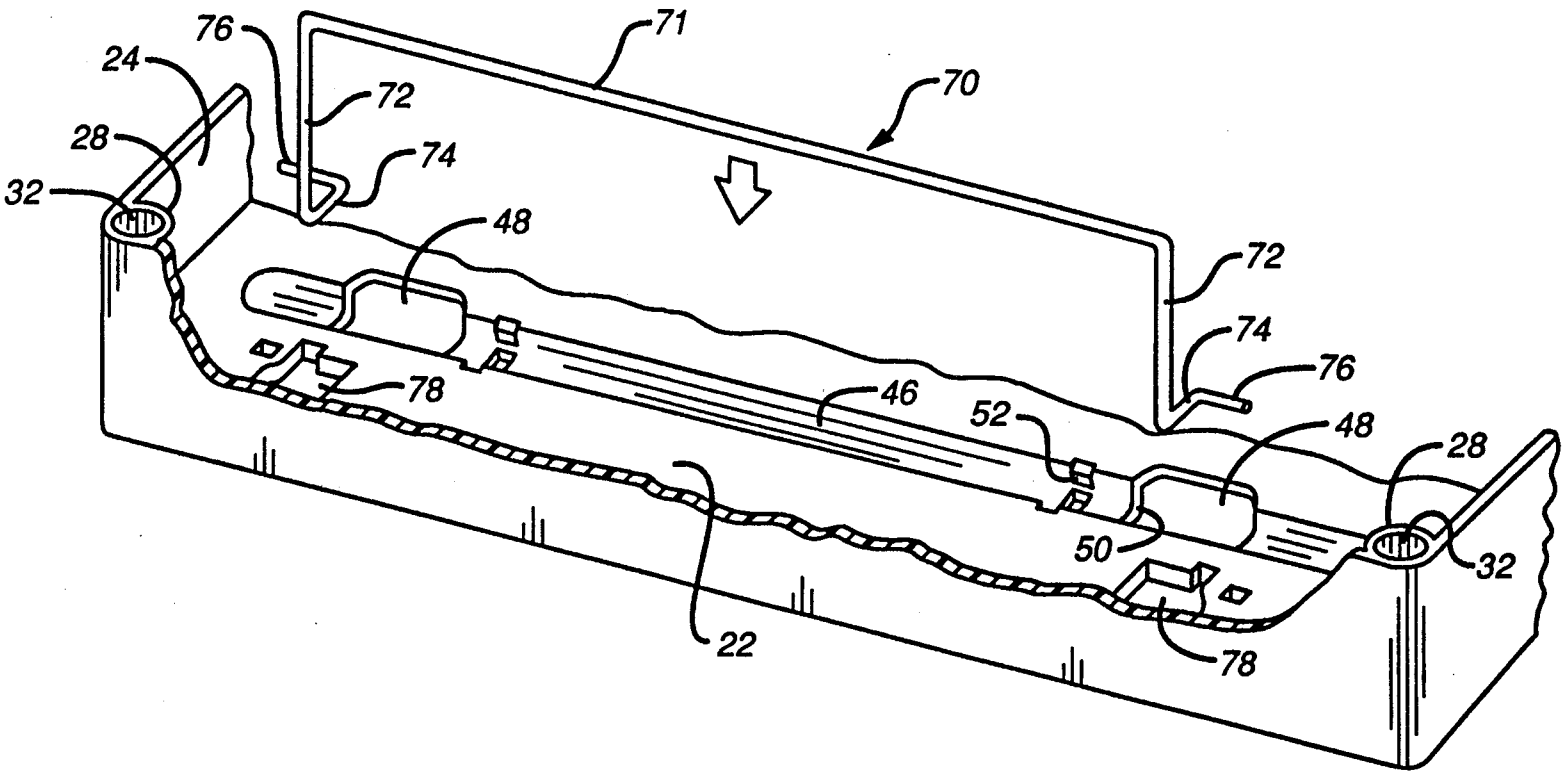
FIG. 6 is an exploded perspective view, partly cut away, of the shelf and a U-shaped guard member.

As best shown in FIG. 6, the U-shaped wire 70 includes a pair of spaced parallel legs 72 joined together through a rail 71, a pair of extensions 74, and a pair of prongs 76. The extensions 74 are joined respectively to the ends of the legs 72 and are extended in a direction generally perpendicular to both the rail 71 and the legs 72. The prongs 76 are joined respectively to the ends of the extensions 74 and are extended away from each other. The length of the legs 72 is greater than the vertical length of the portion of the flange 24 projecting above the base panel 22 so that the rail 71 effectively confines and retains the products 12 supported on the associated shelf 14. The prongs 76 and extensions 74 at the ends of the U-shaped wire 70 are received in pair of connection openings 78 in the base panel 22 to establish the pivotal connection.

Figure 7:
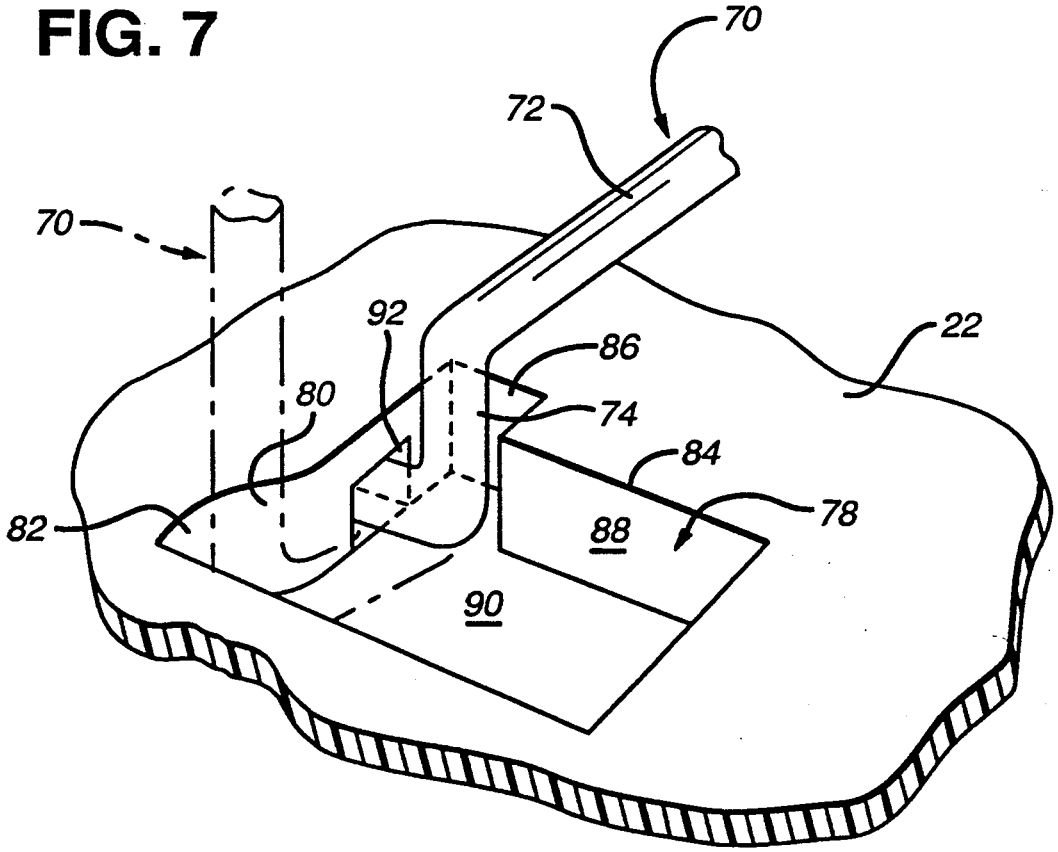
FIG. 7 is an enlarged perspective view of a connection hole with the end portion of the U-shaped guard member received therein.

The connection openings 78, as shown in FIGS. 2 and 6, adjoin one of the longer edges of the base panel 22, and are arranged at a distance from each other along the corresponding longer edge. Each opening 78, as best shown in FIG. 7, is of a periphery conforming to a deformed rectangle. That is, one of the shorter edges of the opening 78 adjacent to the adjacent corner of the base panel 22 (see FIG. 6) is curved and flared outwardly of the opening 78 in such a manner that one of the longer edges of the opening 78 adjoining the flange 24 is greater in length than the other longer edge. The curved portion 80 of the shorter edge of each opening 78 is herein after referred to as "guide portion", and the portion 82 of the opening 78 added to the pure rectangular area due to the guide portion 80 is herein after referred to as "engaging recess".

In addition, the lesser longer edge 84 of the opening 78 is bent outwardly of the opening 78 in such a manner that the opening 78 is expanded at a location near the corner between the lesser longer edge and the curved shorter edge. This expanded portion 86 is adapted to receive, when the wire 70 is in the collapsed position, the associated extension 74 of the U-shaped wire 70 to facilitate the wire 78 to be laid parallel to and in contact with the base panel 22 (see FIG. 7).

As illustrated in FIG. 7, a peripheral wall 88 is formed along the periphery of each opening 78 and extends downward from the periphery of the opening 78. The lower end of the peripheral wall 88 is closed by a bottom wall 90. The portion of the peripheral wall 88 between the guide portion 80 and the expanded portion 86 is provided with a side hole 92 for receiving the prong 76 of the associated one of the legs 72.

As further shown in FIG. 7, each prong 76 of the U-shaped wire 70 is received in the associated side hole 92 for rotational movement about the axis of the prong 76. When the U-shaped wire 70 is in the collapsed position shown by the solid line in FIG. 7, the legs 72 of the U-shaped wire 80 are resiliently bent toward each other against their own resiliency and thus are urged away from each other. When the U-shaped wire 70 is pivoted from the collapsed position to the erected position shown by the phantom line in FIG. 7, the legs 72 of the wire 70 shift away from each other due to their resiliency. As a result, the lower end portion of each leg 72 of the wire 70 is brought into the engaging recess 82, which permits settlement of the U-shaped wire 70 in the erected position. Upon reverse pivotal movement of the wire 70 to the collapsed position, each extension 76 of the wire 70 is guided along the guide portion 80 of the associated opening 78 into the expanded portion 86, and thus the legs 72 are resiliently bent toward each other.

Each shelf 14 may optionally include a plurality of perforations 96 distributed over the base panel 22 at locations where the grooves 36 and 46, finger-receiving apertures 40 and 48, the prop members 68 and the like are not present as shown in FIG. 2. Although the perforations 96 are illustrated as being arranged in parallel rows and columns over substantially the entire extent of the base panel 22, it should be readily apparent that any arrangement of such perforations may be utilized.

In addition, the base panel 22 of each shelf 14 further includes a reinforcing rib arrangement (not shown) provided on the lower surface thereof. The rib arrangement on the base panel 22 includes a plurality of longitudinally extending ribs and a plurality of transversely extending ribs which serve as cross-structure in conjunction with the longitudinally extending ribs.

Although it is recognized that various acceptable materials of construction are available and could equally be employed to construct and fabricate the display stand 10, it is usually preferred that shelves 14 excluding the U-shaped wire 70 are formed of a relatively rigid plastic material. Plastic materials are also somewhat resilient and are suitable for fabricating the sockets 28 and the protrusions 42 and 52. It is also recognized that certain metal, metal alloys, fiberglass or other materials could be utilized in forming the shelves 14. The posts 16 and 20 are preferably formed of metal or metal alloys since they permit relatively thin designs which, in turn, facilitate manufacturing of the shelves 14 having the post holders 36 and 46. When made from a plastic type material, the shelves 14 are suitable for fabrication by either a thermal-forming process or an injection molding process.

How to relocate and how to store the display stand 10 will now be described.

Upon relocation to another store, all the posts 16 and 20 are disconnected at their opposite end portions from the associated shelves 14 or header 18 so that the display stand 10 is disassembled. The disconnected posts 16 are laid in any available grooves 36 of the shelves 14 so that snap engagement is achieved between the posts 16 and the respective engaging means 42 of the grooves 36. Each post 16 should be preferably placed within one of the grooves 36 of the lower adjacent shelf 14, while the disconnected post 20 are laid in any available grooves 46 of the shelves 14. The U-shaped wire 70 of each shelf 14 is folded down into the collapsed position. After that, the shelves 14 whose grooves 36 are occupied by the posts 16 as well as the shelves 14 whose grooves 36 and 46 are occupied by the posts 16 and 20 are stacked one on top of another in nesting relation as shown in FIG. 8. More particularly, the upper end of the flange 24 of each shelf 14 is received in and engaged with the ridge 26 at the lower end of the upper adjacent shelf 14. The shelf 14 provided with the casters 21 is still at the lowermost position when the shelves 14 are stacked.

Figure 9:
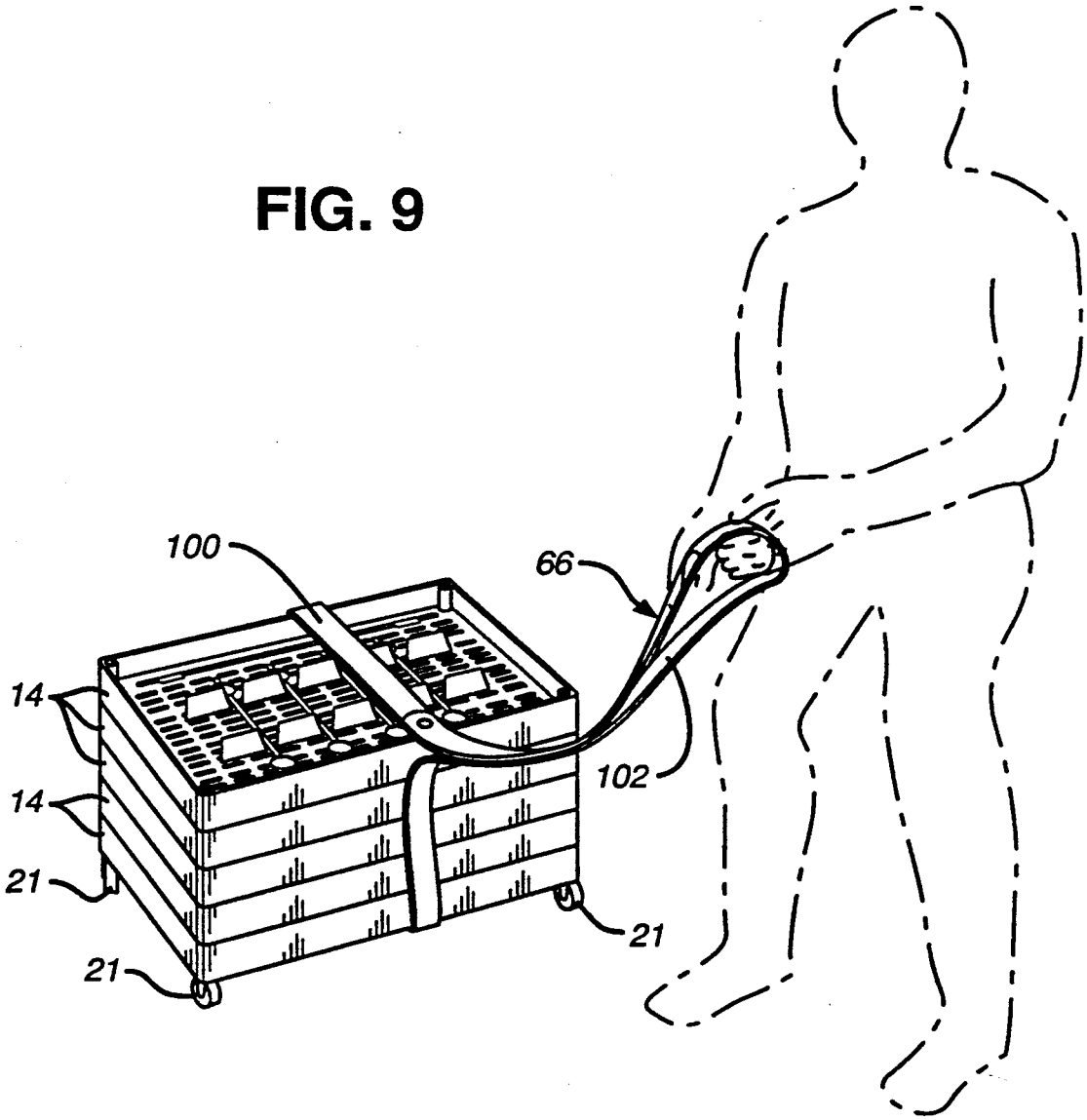
FIG. 9 is a perspective view of the stacked shelves fastened together with the strap.

Subsequently, the rolled strap 66 is detached from the lowermost shelf 14, unrolled, and wound around the stacked shelves 14 to fasten the shelves 14 together. The shelves 14 thus stacked and fastened together is easy to move out of a store for another store, for example, by holding and pulling the handle portion 102 hanging from the stacked shelves 14 as shown in FIG. 9.

When the entire display stand 10 should be stored, steps similar to the steps described above are taken in order to move the display stand 10 to a storage room. Alternately, the display stand 10 in assembled condition is moved to a storage room and then it is knocked down into a stacked unit.

When some of the shelves 14 become unnecessary and thus should be stored, desired number of shelves 14 and the associated posts 16 are removed from the stand 10 and they can be stored in compact fashion wherein all the disconnected posts 16 are held by the removed shelves 14. For example, if the topmost shelf 14 shown in FIG. 1 is unnecessary, it is removed together with the lower adjacent posts 16 from the stand 10, and the disconnected post 16 are placed in the grooves 36 of the removed shelf 14. The lower end portions of the posts 20 may be connected to the second topmost shelf 14 if necessary.

Having described the invention in detail and by reference to the preferred embodiment thereof, it will be apparent that modification and variation are possible without departing from the scope of the invention defined in the appended claims.

What is claimed is:

1. In a display stand for accommodating merchandise thereon, which comprises a plurality of shelf members vertically spaced apart in tiered relationship by a plurality of vertically extending post members positioned between said shelf members, each of said post members being separably connected at upper and lower end portions thereof respectively to upper and lower adjacent ones of said shelf members to connect said upper and lower adjacent shelf members in knockdown relationship, the improvement wherein each of said shelf members comprises a substantially planar base portion for supporting merchandise thereon, and post holder means for releasably holding and snap engagement with at least one of said post members in a condition in which said at least one post member is disposed generally parallel to said base portion whereby said at least one post member and said each shelf member can still be secured together in one compact unit when said at least one post member is disconnected at said upper and lower end portions thereof from the associated one of said shelf members.

2. The display stand according to claim 1, wherein said upper and lower adjacent shelf members are interconnected by two or more of said post members, and said post holder means of said lower shelf member is capable of holding at least all of said post members interconnecting said upper and lower adjacent shelf members.

3. The display stand according to claim 1, wherein said post holder means comprises at least one channel-shaped wall formed on said each shelf member, each of said at least one channel-shaped wall defines a groove for receiving one of said post members, and said groove is of a length no less than the length of said one post member.

4. The display stand according to claim 1, wherein said post holder means comprises a pair of opposed resilient protrusions disposed on the respective one of said shelf members, the distance between said opposed protrusions being less than the transverse size of each of said post members.

5. The display stand according to claim 4, wherein said base portion of each of said shelf members has an upper surface, said post holder means further comprises at least one channel-shaped wall formed on said base portion, each of said at least one channel-shaped wall defining in said upper surface of said base portion a groove for receiving one of said post members, and said resilient protrusions are formed on an internal surface of said groove to prevent said one post member from accidentally coming out of said groove.

6. The display stand according to claim 4, wherein said resilient protrusions are formed adjacent to an opening of said groove, said resilient protrusions defining in said groove a neck portion being less in width than the remainder of said groove, the width of said neck portion being less than the transverse size of each of said post members.

7. The display stand according to claim 4, wherein each of said shelf members is provided with finger-receiving apertures formed in said base portion thereof, said finger-receiving apertures being located in positions such that each of said at least one channel-shaped wall is interrupted by at least one of said finger-receiving apertures, said finger-receiving apertures being of a transverse inside dimension greater than the transverse outer dimension of each of said post members.

8. The display stand according to claim 1, wherein each of said shelf members is of a tray-like structure having a generally horizontal planar base portion for supporting merchandise thereon and an attached peripheral flange extending generally vertically from said base portion to a free end, the perimeter of said flange being greater at said free end than at the attachment to said base portion, whereby upon disassembly, said shelf members can be stacked one on top of another in such a manner that each of said shelf members nests in one of upper and lower adjacent ones of said shelf members.

9. The display stand according to claim 8, further comprising means for fastening said shelf members together in stacked condition upon disassembly, said fastening means comprising a strap member of a length which allows said strap member to be wound around said shelf members in stacked condition, and wherein each of said shelf members further comprises a strap holder for removably holding said strap members in rolled-up condition when said strap member is not in use.

10. The display stand according to claim 8, wherein the lowermost one of said shelf members is provided with wheel means for facilitating movement of said display stand.

11. The display stand according to claim 10, wherein each of said shelf members further comprises connection means for separably engaging with the respective upper and lower end portions of adjacent ones of said post members, and said wheel means is separably engaged with said connection means of the lowermost one of said shelf members.

12. The display stand according to claim 1, each of said shelf members further comprises merchandise prop means extending upward from said base portion thereof, for supporting a rear of said merchandise.

13. The display stand according to claim 1, wherein each of said shelf members further comprises a U-shaped guard member pivotally mounted on a periphery of said base portion for movement between a collapsed position where said guard member is generally parallel to said base portion and an erected position where said guard member is generally perpendicular to said base portion.

14. In a display stand for accommodating merchandise thereon, which comprises a plurality of shelf members vertically spaced apart in tiered relationship by a plurality of vertically extending post members positioned between said shelf members, each of said post members being separably connected at upper and lower end portions thereof respectively to upper and lower adjacent ones of said shelf members to connect said upper and lower adjacent shelf members in knockdown relationship, the improvement wherein each of said shelf members comprises:

a generally horizontal planar base portion for supporting merchandise thereon;

a peripheral flange attached to the periphery of said base portion and projecting below said base portion to a lower free end so as to define a hollow with an open bottom, the perimeter of said flange being greater at said lower free end than at the attachment to said base portion, thereby upon disassembly of said display stand, said shelf members can be stacked one on top of another in such a manner that each of said shelf members nests in upper adjacent one of said shelf members; and merchandise prop means, extending upward from said base portion, for supporting said merchandise, at least a part of said prop means extending into said hollow of said upper adjacent shelf member when said shelf members are stacked, said prop means being of a hollow structure having an open bottom, whereby when said shelf members are stacked, said prop means of each of said shelf members nests in said prop means of said upper adjacent shelf member.

15. The display stand according to claim 14, wherein said peripheral flange is projected also above said base portion to an upper free end, the perimeter of said flange being greater at said lower free end than at said upper free end, and said prop means is not less in vertical length than that portion of said flange projecting above said base portion.

16. In a display stand for accommodating merchandise thereon, which comprises a plurality of shelf members vertically spaced apart in tiered relationship by a plurality of vertically extending post members positioned between said shelf members, each of said post members being separably connected at upper and lower end portions thereof respectively to upper and lower adjacent ones of said shelf members to connect said upper and lower adjacent shelf members in knockdown relationship, the improvement wherein each of said shelf members comprises:

post holder means provided thereon for releasably holding at least one of said post members when said at least one post member is disconnected at said upper and lower end portions thereof from the associated ones of said shelf members; and a substantially planar base portion for supporting merchandise thereon, said base portion having an upper surface, said post holder means holding said at least one post member in such a manner that said at least one post member is disposed substantially parallel to said base portion, said post holder means comprising at least one channel-shaped wall formed on said base portion, each of said at least one channel-shaped wall defining in said upper surface of said base portion a groove for receiving one of said post members.

17. A display stand for accommodating merchandise thereon, comprising a plurality of shelf members vertically spaced apart in tiered relationship by a plurality of vertically extending post members positioned between said shelf members, each of said post members being separably connected at upper and lower end portions thereof respectively to upper and lower adjacent ones of said shelf members to connect said upper and lower adjacent shelf members in knockdown relationship, each of said shelf members comprising post holder means provided thereon for releasably holding at least one of said post members when said at least one post member is disconnected at said upper and lower end portions thereof from the associated ones of said shelf members, said post holder means comprising at least one channel-shaped wall formed on the respective one of said shelf members, each of said at least one channel-shaped wall defining a groove for receiving the entire length of one of said post members, said groove being of a length no less than the length of said one post member.

18. The display stand according to claim 13, wherein said groove is of a width no less than the transverse size of said one post member.

19. A display stand for accommodating merchandise thereon, comprising:

a plurality of shelf members vertically spaced apart in tiered relationship by a plurality of vertically extending post members positioned between said shelf members, each of said post members being separably connected at upper end lower end portions thereof respectively to upper and lower adjacent ones of said shelf members to connect said upper and lower adjacent shelf members in like structure such that upon disassembly of said display stand, said shelf members can be stacked together; and means for fastening said shelf members together in a stacked condition upon disassembly of said display stand, said fastening means comprising a strap member of a length which allows said strap member to be wound around said shelf members in a stacked condition, said each shelf member comprising a strap holder for removably holding said strap member in a rolled-up condition when said strap member is not in use.

20. The display stand according to claim 19, wherein said each shelf member further comprises a generally horizontal planar base portion for supporting merchandise thereon and an attached peripheral flange extending generally vertically from said base portion to a free end, the perimeter of said flange being greater at said free end than at the attachment to said base portion, whereby upon disassembly, said shelf members can be stacked together in such a manner that each of said shelf members nests in one of upper and lower adjacent ones of said shelf members.

* * * * *

UNITED STATES PATENT AND TRADEMARK OFFICE

CERTIFICATE OF CORRECTION

PATENT NO. : 5,238,128

DATED : August 24, 1993

INVENTOR(S) : David C. F. Stoddard

It is certified that error appears in the above-identified patent and that said Letters Patent is hereby corrected as shown below:

Column 11, line 40, "claim 4" should read --claim 5--.

Column 11, line 47, "claim 4" should read --claim 5--.

Column 12, line 50, "thereby" should read --whereby--.

Column 14, line 8, "claim 13" should read --claim 17--.

Column 14, line 17, "end" (first occurrence) should read --and--.

Column 14, line 20, "in like" should read --in knockdown relationship, each of said shelf members being of a tray-like--.

Signed and Sealed this

Twelfth Day of April, 1994

*Attest:*

Bruce Lehman

BRUCE LEHMAN

*Attesting Officer*

*Commissioner of Patents and Trademarks*